United States Patent [19]

Hoffman

[11] 4,196,956

[45] Apr. 8, 1980

[54] DEAD-FRONT ELECTRICAL CONNECTOR

[75] Inventor: Ernest G. Hoffman, Middlefield, Conn.

[73] Assignee: Harvey Hubbell, Incorporated, Orange, Conn.

[21] Appl. No.: 963,656

[22] Filed: Nov. 24, 1978

Related U.S. Application Data

[63] Continuation of Ser. No. 868,216, Jan. 9, 1978, abandoned, which is a continuation-in-part of Ser. No. 772,672, Feb. 28, 1977, Pat. No. 4,067,634, which is a continuation of Ser. No. 609,797, Sep. 2, 1975, Pat. No. 4,010,999.

[51] Int. Cl.[2] ..... H01R 13/58

[52] U.S. Cl. ..... 339/107; D13/27; 339/176 MP

[58] Field of Search ..... 339/107, 59 M, 75 MP, 339/95, 97, 98, 99, 91 R, 105, 128, 131, 176 MP, 210 M; D13/27, 30

[56] References Cited

U.S. PATENT DOCUMENTS

| | | | |
|---|---|---|---|
| 4,138,185 | 2/1979 | Jaconnette, Jr. | 339/107 |

FOREIGN PATENT DOCUMENTS

| | | | |
|---|---|---|---|
| 2053213 | 3/1972 | Fed. Rep. of Germany | 339/107 |
| 1394871 | 3/1965 | France | 339/107 |
| 40-14272 | 5/1965 | Japan . | |
| 676144 | 7/1952 | United Kingdom | 339/107 |

*Primary Examiner*—Roy Lake
*Assistant Examiner*—DeWalden W. Jones
*Attorney, Agent, or Firm*—Jerry M. Presson

[57] ABSTRACT

An integrally molded housing has a dead-front base and a pair of side covers pivotally connected to it by web hinges. The side covers fold about the web hinges to: (i) force cord conductors into insulation displacement terminals affixed to the housing and thus wire the connector; (ii) safely enclose the wiring area; and (iii) lock the side covers to the dead-front base by the engagement of mating portions of the covers and base to prevent relative motion even should the web hinges fail. The connector can have male or female contacts or both. It provides speed and convenience of wiring and assembly and ensures quality wiring by eliminating the variability in workmanship associated with conventional stripping of conductor ends and screw tightening used for screw type terminals.

42 Claims, 21 Drawing Figures

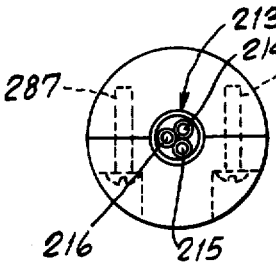
Fig. 12.
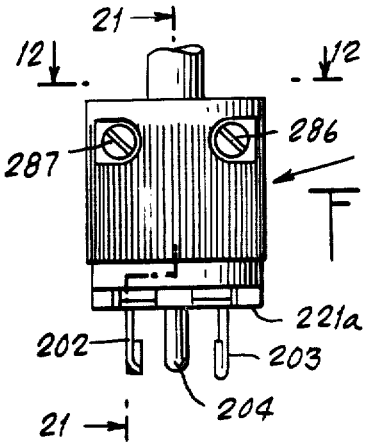
Fig. 11.
Fig. 13.
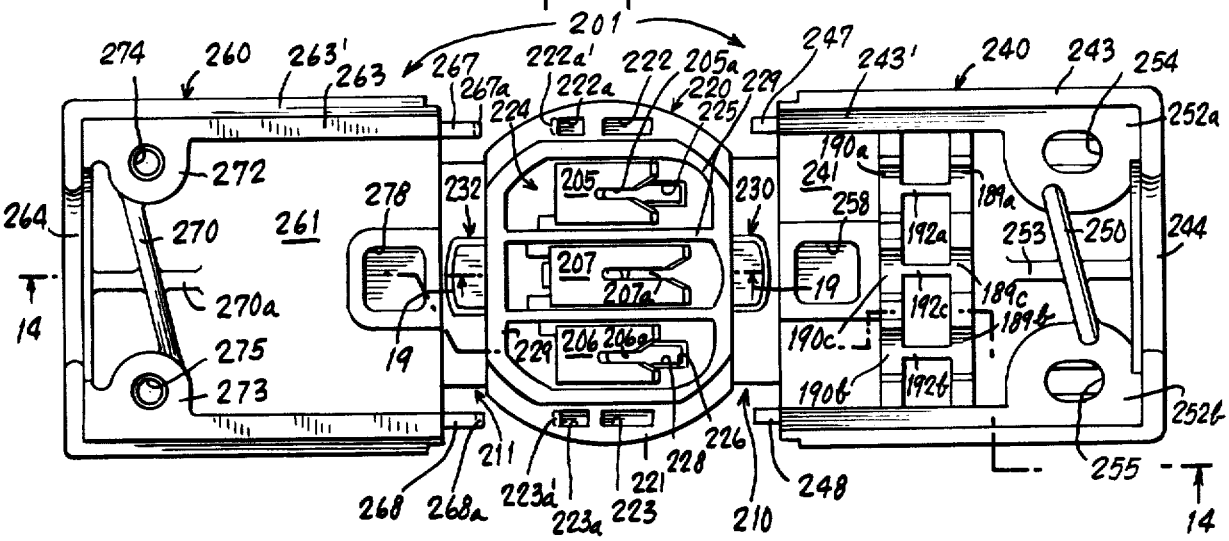
Fig. 14.
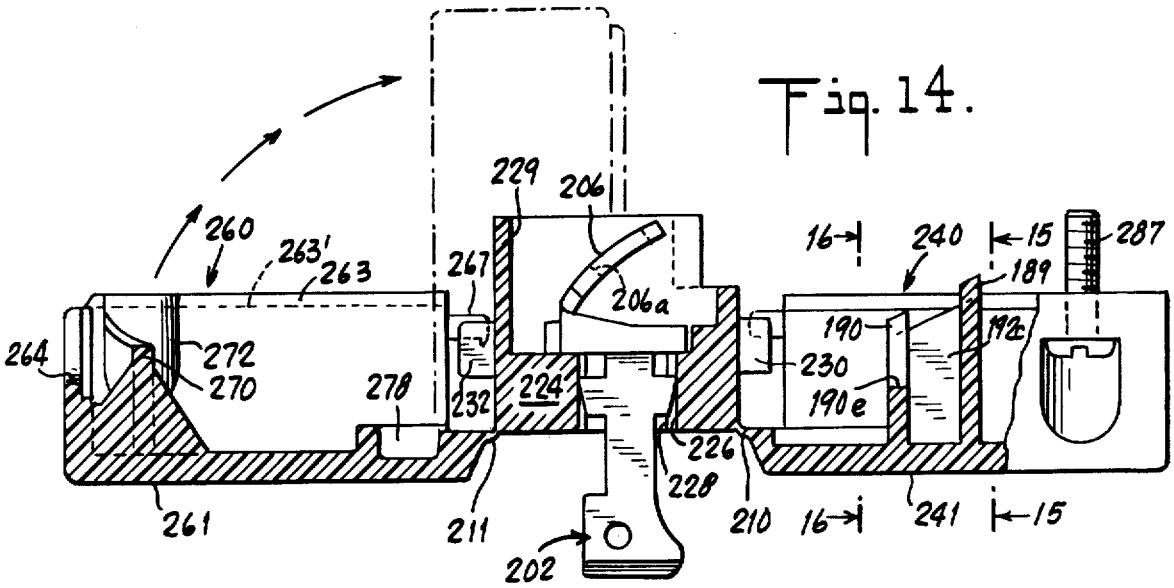

DEAD-FRONT ELECTRICAL CONNECTOR

REFERENCE TO RELATED APPLICATION

This is a continuation of application Ser. No. 868,216, filed Jan. 9, 1978, now abandoned, which is a continuation-in-part of parent application Ser. No. 772,672 filed Feb. 28, 1977, now U.S. Pat. No. 4,067,634 granted Jan. 10, 1978, which is in turn a continuation of grandparent patent application Ser. No. 609,797 filed Sept. 2, 1975, now U.S. Pat. No. 4,010,999 granted Mar. 8, 1977. The parent and grandparent applications are hereby incorporated by reference into this continuation-in-part application.

BACKGROUND AND SUMMARY OF THE INVENTION

The invention relates to a dead-front electrical connector which is inexpensive to manufacture and safe to use.

There are two broad categories of electrical plug connectors: live-front and dead-front type. In the live-front type, the screws for securing the cord conductors to the terminals are reached through the face or front of the connector. After the screws are tightened the front is usually covered by a removable insulating disc. This type of connector has few parts and is simple and inexpensive. It requires, however, a high level of care in wiring and maintenance to ensure safety. One common danger of such connectors is that the removable insulating disc covering the front may become damaged or lost and the live terminals may thereby be exposed. In connectors of the dead-front type there is a heavy insulating base at the front of the connector and the terminal screws are accessed from behind this base. The wiring area is usually fully enclosed after wiring. Such connectors can accommodate greater variations in the quality of wiring and maintenance without loss of safety or service. However, prior art electrical connectors of the dead-front type generally have had more parts and have been more costly to produce than connectors of the live-front type.

One of the many ways of connecting insulated conductors to terminals of wiring devices is the so-called insulation displacement technique which typically involves pushing a conductor into a terminal slot by a pair of hand pliers such that the slot cuts through the insulation and makes electrical contact with the conductor wire. This technique typically requires skillful operators and convenient access to the terminal slots permitting the use of hand pliers.

The invented connector is of the dead-front type and makes use of a particularly convenient and effective combination of pivoted side covers, locking means and insulation-displacement terminals. One embodiment of the connector comprises a housing made up of a dead-front base and a pair of side covers having front ends pivotally connected to the base by web hinges. The base and side covers are integrally molded as a one-piece structure made of an electrically insulating material. The base supports terminals, such as a pair of power terminals and a ground terminal, which have wiring ends extending back of the base. The terminals may have male contacts, such as a pair of power blades and a ground pin extending through suitable openings in the dead-front base, or they may have female contacts receiving male contacts passing through suitable openings in the dead-front base, or both types of contacts. There are locking portions molded integrally with the dead-front base and the side covers which engage when the connector is closed and the back ends of the side cover are secured to each other, which locking portions resist relative motion between the side covers and the dead-front base so as to supplement and even replace, if needed, the holding action provided by the web hinges. The electrical cord may be wired to the terminals in the course of folding the side covers to close the connector by having the wiring ends of the terminals in the form of insulation displacement slots opening toward one of the side covers. The intact insulated conductor wires of the cord are laid against the open ends of the terminal slots and the conductors are pushed into the slots, as the side cover facing the open ends of the slots is being closed, by a pusher shelf or shelves integrally formed with that side cover and suitably disposed with respect to the terminal slots. The terminal slots may be curved to be along an arc centered at one of the hinges so as to facilitate the insulation displacement connection. Their open ends may be staggered such that one of the cord conductors would start being pushed into its slot before another. The dead-front base may have barrier walls which surround the wiring parts of the terminals to keep them out of electrical contact with each other and, moreover, to prevent the terminal slots from being undesirably widened when the insulated conductors are being pushed into them. The locking means which resist relative motion between the side covers and the dead-front base when the connector is closed may include integrally formed means for locking, in a permanently closed position, the side cover which does not face the open ends of the terminal slots so as to use the permanently locked side cover as a shelf against which the cord conductors can be laid prior to closing the other cover so as to make the insulation displacement connection.

The objects of the invention include providing a high strength, one-piece housing for a dead-front electrical connector, providing a housing of this type which fully insulates the wiring area of the connector, providing a dead-front electrical connector which affords great ease of wiring and assembly, providing a dead-front connector which eliminates the variability of workmanship associated with screw-type terminal wiring and stripping of conductor ends for screw-type terminals, providing a connector having a housing made up of a dead-front base and web-hinged side covers which lock to the housing when closed so as to remain locked even in the absence of the holding action of the web hinges, and providing a dead-front connector which is particularly simple and inexpensive to make, assemble and use. These and other objects of the invention are discussed in more detail in the appended Detailed Description.

BRIEF DESCRIPTION OF THE DRAWINGS

FIG. 11 is a side elevational view of an assembled third embodiment of an electrical connector made in accordance with my present invention.

FIG. 12 is a sectional view taken along lines 12—12 of FIG. 11.

FIG. 13 is a top view of an open position of the connector shown in closed position in FIG. 11.

FIG. 14 is a partly side elevational and partly sectional view taken along lines 14—14 of FIG. 13.

The same reference numerals refer to the same elements throughout the various figures.

DETAILED DESCRIPTION

Figure 1:
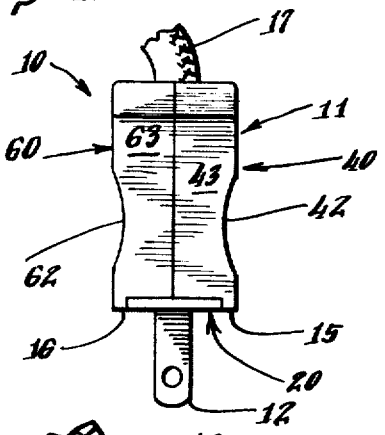
FIG. 1 is an end view of an electrical plug connector disclosed in my earlier applications which have become U.S. Pat. Nos. 4,067,634 and 4,010,999.

FIGS. 1 through 10 are fully described in the parent and grandparent applications, and the description thereof is repeated at least in substance below.

In FIGS. 1-6 there is shown a one-piece dead-front electrical plug 10 of high strength. The dead-front electrical plug 10 comprises generally a plug body 11 and two power blades 12 and 13, and is adapted to make electrical connection between a cord 17 and a standard electrical socket outlet, now shown. The plug body 11 is generally comprised of a dead-front member 20 through which power blades 12 and 13 are mounted, and two side covers 40 and 60. The side covers 40 and 60 are hingedly connected to the dead-front member 20 by web hinges 15 and 16, and the entire plug body 11 is formed integrally of a high strength insulating material, such as nylon.

Referring now to FIGS. 3-6 in which the details of the structure of the dead-front electrical plug 10 are shown, the dead-front member 20 is comprised of a rectangular bottom plate 21 which forms a smooth base or front of the plug except for two elongated notch openings 22 and 23 located midway along the side edges of the bottom plate 21 adjacent to side covers 40 and 60, respectively. An upstanding flange 24 is provided about the rectangular periphery of the bottom plate 21. Two additional upstanding flanges 25 and 26 together with the peripheral flange 24 define two elongated grooves 27 and 28 which are parallel to the end edges of the bottom plate 21.

A block 30 is integrally formed with and upstands from the central inner area of the bottom plate 21, and a rectangular groove 31 is defined surrounding the sides of the block 30 between it and the flanges 24-26. The block 30 serves as a mounting and support member for the power blades 12 and 13, which are press fit into openings extending through the block 30 and the bottom plate 21 integral therewith. The upper terminal ends of the power blades 12 and 13 are provided with terminal screws 18 and 19 which are readily accessible when the dead-front electrical plug is in the open condition shown in FIGS. 5 and 6 for facilitating wire connections with wire conductors 32 and 33 of cord 17. An "H" shaped insulation barrier 34 is formed integrally with and upstanding from the block 30, and is positioned between the upper terminal ends of power blades 12 and 13.

Figure 4:
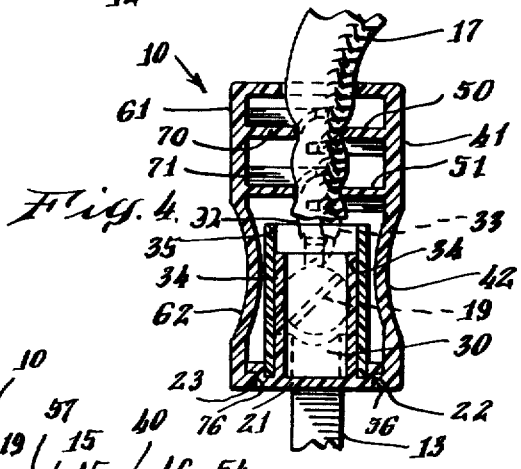
FIG. 4 is a sectional view of the electrical plug connector of FIG. 1 taken along the lines 4—4 of FIG. 2.
Figure 5:
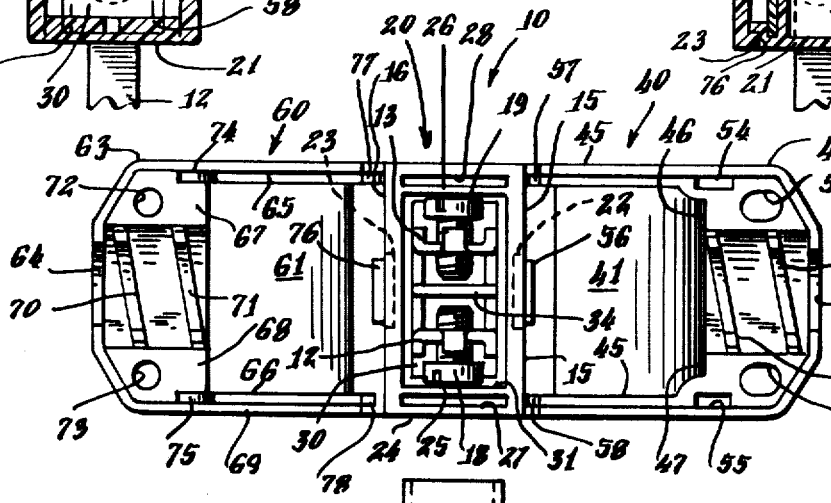
FIG. 5 is a top view of the electrical plug connector of FIG. 1 in its open condition.

Referring particularly to FIGS. 4 and 5, it will be noted that the rectangular groove 31 defined between the block 30 and the flanges 24-26 is adapted to receive the lower end of an optional rectangular sealing compound barrier sleeve 35. The sealing compound barrier sleeve 35 surrounds the upper ends of the power blades 12 and 13, their associated terminal screws 18 and 19, and any uninsulated or stripped portion of the wire conductors 32 and 33 adjacent to their connection to the terminal screws. The sealing compound barrier sleeve 35 is filled with a sealing or potting compound (not shown) which cures to provide a protective, fully moisture-proof wiring connection between the wire conductors and the power blades. Of course, the sealing compound barrier sleeve 35 and sealing compound may be omitted and are not necessary to the structure of the dead-front electrical plug 10, although they do provide additional safety and service features and are accordingly preferred.

Figure 6:
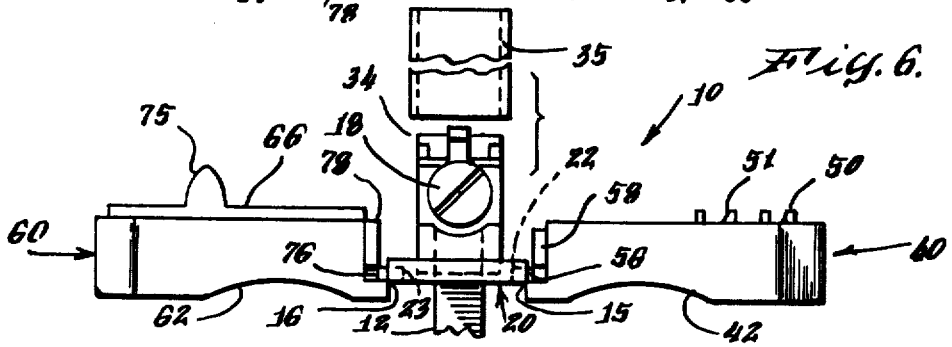
FIG. 6 is an end view of the electrical plug connector of FIG. 1 in its open condition.
Figure 7:
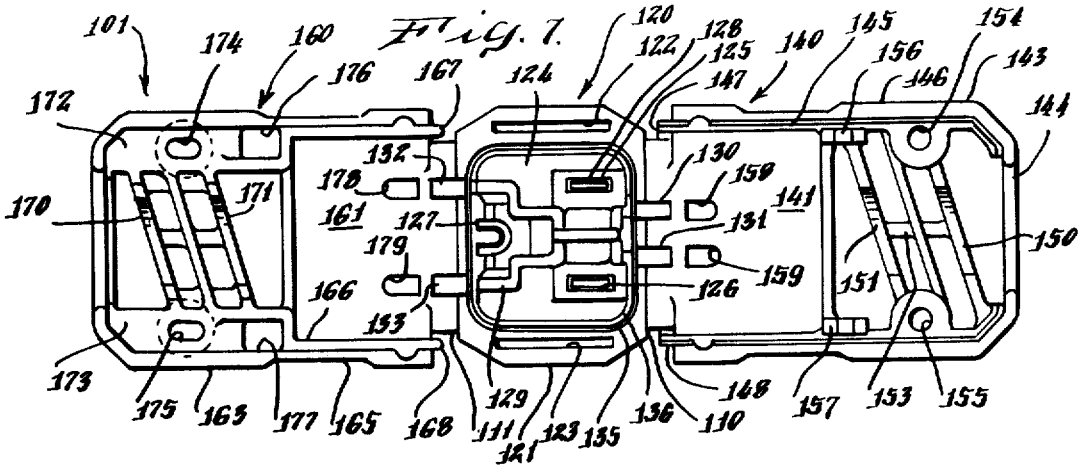
FIG. 7 is a top view of another electrical plug connector disclosed in my earlier applications, in its open condition.

The plug body 11 of the dead-front electrical plug 10 further comprises side covers 40 and 60 which are integrally connected to the dead-front member 20 by means of web hinges 15 and 16, respectively. As best seen in FIGS. 5 and 6, web hinges 15 and 16 each comprise two thin, aligned, flexible webs which flank the notches 22 and 23 in the bottom plate 21 of the dead-front member 20 and extend between the bottom plate 21 and the side covers 40 and 60, whereby the side covers are pivotally mounted with respect to the dead-front member 20.

Figure 2:
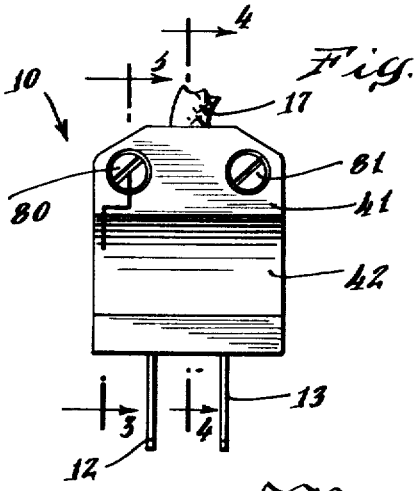
FIG. 2 is a front view of the electrical plug connector of FIG. 1.

The side cover 40 comprises a front panel 41, which, as viewed in FIG. 2, comprises the front of the dead-front electrical plug 10. A concave portion 42 of the front panel 41 cooperates with a similar concave portion 62 on panel 61 of side cover 60, which comprises the back of the electrical dead-front plug 10, as viewed in FIG. 2, to facilitate gripping the assembled plug for inserting it into and removing it from electrical socket outlets.

The side cover 40 further comprises a wall 43 which is generally perpendicular to and extends around three sides of the front panel 41. The wall 43 forms substantially one-half of the ends and top of the assembled dead-front electrical plug 10, as best seen in FIG. 1. In the portion of wall 43 which forms the top of the assembled dead-front electrical plug 10 there is defined a semi-circular opening 44 which accommodates the passage of cord 17.

The wall 43 further includes a shoulder 45 which extends about the inner periphery thereof except at the semi-circular opening 44. The shoulder 45 is partially defined by two blocks 46 and 47 which are also integral with the front panel 41. Two cord clamp teeth 50 and 51 upstand from the inner surface of front panel 41 and are integral with and diagonally disposed between the two blocks 46 and 47. The upper surfaces of the cord clamp teeth 50 and 51 are concave.

Figure 3:
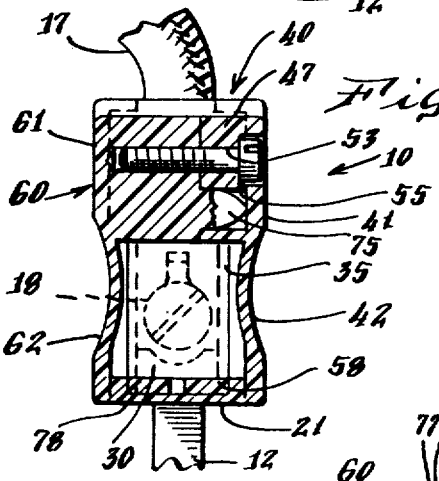
FIG. 3 is a sectional view of the electrical plug connector of FIG. 1 taken along the lines 3—3 of FIG. 2.

Two oblong openings 52 and 53 are formed through the blocks 46 and 47, respectively, and front panel 41 integral therewith, flanking the cord clamp teeth 50 and 51. The openings 52 and 53 are preferably countersunk adjacent to the front panel 41, as best seen in FIG. 3. Two additional rectangular openings 54 and 55 are formed partially through blocks 46 and 47, respectively, from the shoulder 45 of side wall 43.

The side cover 40 further comprises a rectangular flange 56 upstanding from the inner surface of front panel 41 between the two webs comprising the web hinge 15, and flange 56 is matingly received in the notch 22 formed in the dead-front member 20 when the dead-front electrical plug 10 is in its fully assembled condition, as best seen in FIG. 4. Two additional flanges 57 and 58 extend from the ends of wall 43, and are received in the grooves 27 and 28 of the dead-front member 20 when the dead-front electrical plug 10 is in its assembled condition, as best seen in FIG. 3.

As noted above, the side cover 60 is comprised of a back panel 61 having a concave portion 62. The side cover 60 is integrally hingedly connected to the dead-front member 20 by means of web hinge 16. A wall 63 upstands generally perpendicularly to the back panel 61 and extends around three sides thereof, and the wall 63 is shaped to cooperate with wall 43 of side cover 40 to form the ends and top of the assembled dead-front electrical plug 10. A semi-circular opening 64 is defined by the wall 63 opposite the opening 44 in wall 43 such that the two openings 44 and 64 together accommodate passage of the cord 17. Integral with the wall 63 along the inside edge thereof are two flanges 65 and 66 and two blocks 67 and 68. A shoulder 69 is formed along the outside of wall 63 adjacent to the flanges 65 and 66 and the blocks 67 and 68.

Two cord clamp teeth 70 and 71 upstand from the back panel 61 and are integral with and extend diagonally between the blocks 67 and 68. The upper surfaces of the cord clamp teeth 70 and 71 are concave, and it will be noted that the diagonal orientation of the cord clamp teeth 70 and 71 is opposite to that of cord clamp teeth 50 and 51 of side cover 40 such that the two sets of cord clamp teeth crisscross when the dead-front electrical plug 10 is in its assembled condition.

Two openings 72 and 73 are formed partially through the blocks 67 and 68, respectively, flanking the cord clamp teeth 70 and 71. Protruding upwardly from the flanges 65 and 66, respectively, are two prongs 74 and 75. Side cover 60 further comprises a flange 76 upstanding from the interior surface of the back panel 61 between the webs of web hinge 16 and juxtaposed the notch 23 in the dead-front member 20, and flange 76 is matingly received in notch 23 when the electrical dead-front plug 10 is in its assembled condition. Two additional flanges 77 and 78 are provided at the terminal ends of wall 63 and are received in grooves 28 and 27, respectively, as best seen in FIG. 3.

The dead-front electrical plug 10 is assembled by first stripping and connecting the ends of the two wire conductors 32 and 33 of cord 17 to the upper ends of the power blades 12 and 13 via terminal screws 18 and 19. The sealing compound barrier sleeve 35 and sealing compound, if desired, are then placed over the wire connections. After wiring has been completed, the side covers 40 and 60 are pivoted together so that the electrical dead-front plug 10 is in the assembled condition illustrated in FIGS. 1–4. The flanges 65 and 66 of side cover 60 butt against the shoulder 45 of side cover 40 and lie inside the wall 43 thereof. Similarly, the upper portion of wall 43 fits tightly against shoulder 69. This overlapping engagement between side covers 40 and 60 provides for a dust free interior of the dead-front electrical plug 10 and makes it resistant to the insertion of foreign objects.

Top surfaces of blocks 46 and 47 butt against the top surfaces of blocks 67 and 68. The prongs 74 and 75 of side cover 60 are received in the openings 54 and 55 of side cover 40, and the interengagement therebetween keeps the side covers 40 and 60 in alignment as the cord clamp teeth 50, 51, 70 and 71 grip the cord 17, as best seen in FIG. 4, and thereby relieve any strain on the wiring connections. The through openings 52 and 53 formed in side cover 40 align with the partial openings 72 and 73 in blocks 67 and 68 formed in side cover 60, and two self-threading screws 80 and 81 are threaded into the openings to secure the side covers 40 and 60 together.

As noted above, the flanges 56 and 76 are respectively matingly received in the notches 22 and 23 of the dead-front member 20, and the resultant interengagement provides longitudinal strength between the side covers 40 and 60 and the dead-front member 20 of the plug 10. Thus, the cooperation of flanges 56 and 76 and notches 22 and 23 relieves any longitudinal stress which would otherwise be placed on the web hinges 15 and 16 when the side covers are gripped to remove the dead-front electrical plug from an electrical socket outlet. Similarly, the flanges 57 and 77 are received in the groove 28 in the dead-front member 20 and the flanges 58 and 78 are received in the groove 27 of the dead-front member 20 (as best seen in FIG. 3) to relieve any lateral stress extant between the side covers 40 and 60 and the dead-front member 20.

During assembly of the dead-front electrical plug 10, it may be desirable to add a rubber grommet (not shown) around the cord 17 between the semi-circular openings 44 and 64, and such grommet may be used alone or in addition to the sealing compound barrier sleeve 35 and sealing compound.

Thus, the dead-front electrical plug 10 achieves the safety advantages of dead-front type electrical plugs and yet is extremely easy to wire, is extremely strong in its assembled condition, and is dust-proof and moisture-proof.

Referring now to FIGS. 7–10, there is shown a second embodiment 100 of a dead-front electrical plug. It generally comprises a plug body 101, shown alone in FIG. 7, two power blades 102 and 103, and a ground pin 104. The dead-front electrical plug 100 is adapted to make electrical connection between a cord 113 comprising three wire conductors 114–116 and a grounded electrical socket outlet, now shown. The plug body 101 of the dead-front electrical plug 100 is generally comprised of a dead-front member 120 and two side covers 140 and 160 which are hingedly connected thereto by web hinges 110 and 111. The entire plug body 101 is integrally formed of an insulating material, which may be nylon.

The dead-front member 120 of the plug body 101 comprises a base plate 121, the outer surface of which forms a smooth insulating face or front of the dead-front electrical plug 100. Two parallel grooves 122 and 123 are formed partially through the base plate 121 adjacent the end edges thereof. A thicker central portion 124 of the dead-front member 120 is formed integrally with the base plate 121 thereof and serves as a supporting and mounting block for the power blades 102 and 103 and the ground pin 104. To this end two rectangular openings 125 and 126 and a U-shaped opening 127 are formed through the central portion 124 and integral base plate 121 to receive the power blades 102 and 103 and the ground pin 104, respectively. Each of the openings 125–127 is preferably provided with a sealing lip, e.g., sealing lip 128 of opening 125, which extends laterally into the opening adjacent the bottom surface of the base plate 121.

Figure 8:
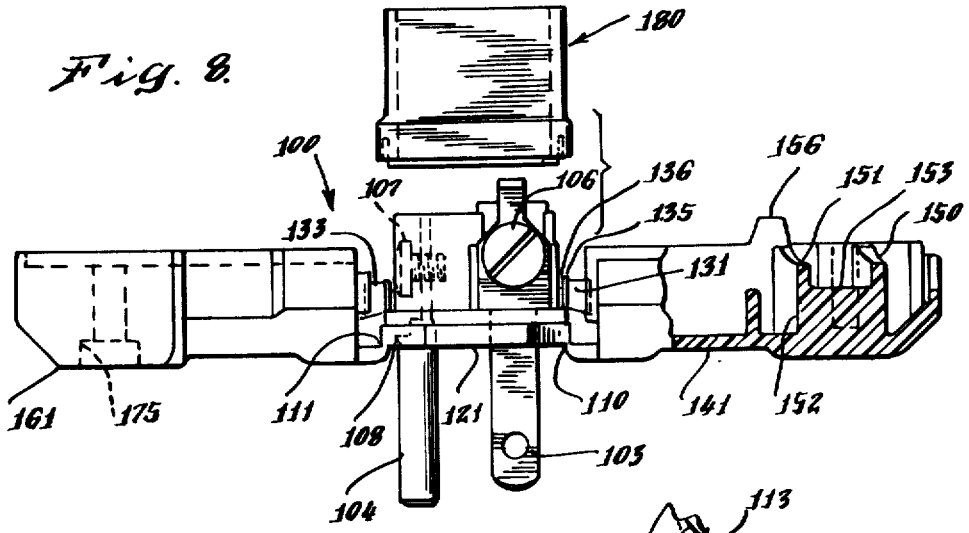
FIG. 8 is an end view of the electrical plug connector of FIG. 7 in its open position.

The power blades 102 and 103 and the ground pin 104 are pushed through the openings 125–127 and are retained therein by integral barbs, such as barb 108 of ground pin 104, best seen in FIG. 8. The upper ends of the power blades 102 and 103 and the ground pin in 104 are provided with terminal screws 105–107, respectively, for making wiring connections with the three wire conductors 114–116 of cord 113. An insulation barrier 129 is integral with and upstanding from the central portion 124 of the dead-front member 120 and serves to isolate the power blades 102 and 103, the ground pin 104, and their associated terminal screws and any adjacent uninsulated portion of the wire conductors from each other.

Two dowel pins 130 and 131 protrude laterally from one side of the dead-front member 120. More particularly, the dowel pins 130 and 131 are positioned between the power blades 102 and 103, and are integral with the top of the thick central portion 124 and the insulation barrier 129 of the dead-front member 120. Two additional dowel pins 132 and 133 protrude laterally from the opposite side edge of the dead-front member 120, and dowel pins 132 and 133 are also integral with the thick central portion 124 and the insulation barrier 129. The dowel pins 132 and 133 flank the upper end of the ground pin 104 and its associated terminal screw 107. The dead-front member 120 further comprises a circumferential flange 135 and an associated groove 136 formed between it and the thick central portion 124. The flange 135 and groove 136 extend about the periphery of the thick central portion 124, and are elevated to pass over the dowel pins 130 to 133.

Figure 9:
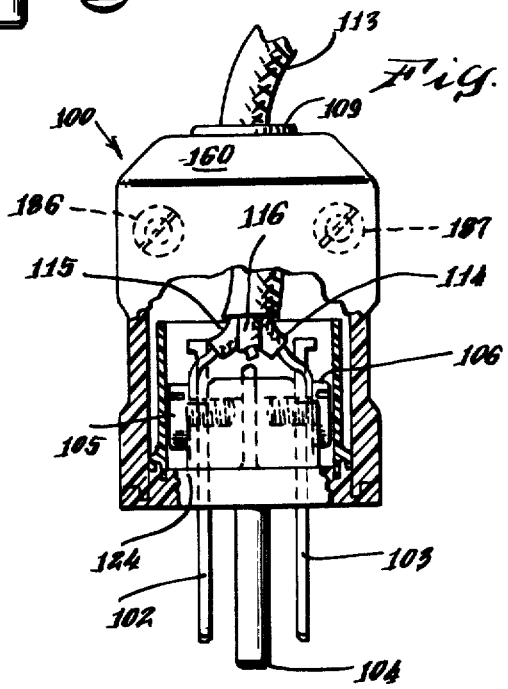
FIG. 9 is a front view, partially cut away of the electrical plug connector of FIG. 7 in its closed position.
Figure 15:
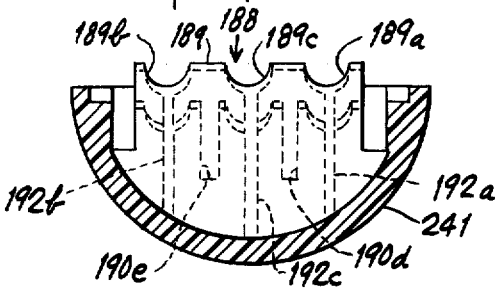
FIG. 15 is a sectional view taken along lines 15—15 of FIG. 14.

The side cover 140 comprises a panel 141, which forms the back of the assembled dead-front electric plug 100 as viewed in FIG. 9. Web hinge 110 comprises a thin web of the plug material which is integral with both the back panel 141 and the dead-front member 120, and thereby hingedly connects the dead-front member 120 with the side cover 140.

A U-shaped wall 143 upstands generally perpendicularly from the periphery of back panel 141 around three sides thereof to form substantially one-half of the top and ends of the assembled dead-front electrical plug 100. The wall 143 defines a semi-circular opening 144 which accommodates the passage of cord 113 and a surrounding sealing grommet 109. The upper edge of the wall 143 includes a flange 145 along the inside thereof, and a shoulder 146 is defined adjacent to the flange 145 along the outside of wall 143. The flange 145 is contiguous with two additional flanges 147 and 148 which protrude laterally from the ends of wall 143 as viewed in FIGS. 7 and 8, in alignment with the grooves 122 and 123, respectively, of the dead-front member 120.

Two parallel cord clamp teeth 150 and 151 are diagonally disposed between the legs of U-shaped wall 143 adjacent to the semi-circular opening 144. The cord clamp teeth 150 and 151 are integral with a thickened portion 152 of the back panel 141, and strengthening ribs 153 may also be provided in connection with the cord clamp teeth. Two openings 154 and 155 are formed partially through the side cover 140 in thickened surrounding portions of the wall 143, flanking the cord clamp teeth 150 and 151. Two prongs 156 and 157 are formed extending upwardly from the opposite legs of the U-shaped wall 143.

The back panel 141 of side cover 140 is provided with two openings 158 and 159 which matingly receive the dowel pins 130 and 131 when the dead-front electrical plug 100 is in its assembled condition shown in FIG. 9.

Side cover 160 is similar to side cover 140, and comprises a panel 161 which forms the front of the assembled dead-front electrical plug as viewed in FIG. 9. The side cover 160 is hingedly connected to the dead-front member 120 by means of web hinge 111. An upstanding U-shaped wall 163 extends around three sides of the back panel 160, and the wall 163 forms substantially the other half of the top and ends of the assembled dead-front electrical plug 100. The wall 163 defines a semi-circular opening 164 which cooperates with the opening 144 in wall 143 to accommodate passage of the cord 113 and its associated grommet 109. The upper edge of wall 163 terminates in a flange 165 and a shoulder 166, the flange 165 being disposed on the outside of the wall 143 and the shoulder 166 being located on the inside immediately adjacent thereto. Two additional flanges 167 and 168 protrude laterally from the ends of the U-shaped wall 163 as viewed in FIGS. 7 and 8, and are in alignment with the grooves 122 and 123, respectively, of the dead-front member 120.

Two parallel cord clamp teeth 170 and 171 are diagonally disposed between two blocks 172 and 173, the blocks 172 and 173 being integral with both the wall 163 and front panel 161 of side cover 160. The cord clamp teeth 170 and 171 are oppositely diagonally disposed to the cord clamp teeth 150 and 151 of side cover 140 such that the two sets of cord clamp teeth crisscross when dead-front electrical plug 100 is assembled. Two openings 174 and 175 are formed in the blocks 172 and 173 respectively, and the openings 174 and 175 are countersunk into the outside surface of front panel 161, as best seen in FIG. 8. Two additional openings 176 and 177 are formed in the blocks 172 and 173, respectively, adjacent to the legs of the U-shaped wall 163. The panel 161 defines an additional two openings 178 and 179 which receive the dowel pins 132 and 133 when the electrical dead-front plug 100 is assembled.

The dead-front electrical plug 100 is assembled by first connecting the wire conductors 114–116 of cord 113 to the power blades 102 and 103 and the ground pin 104 via the terminal screws 105–107. The wiring connections are easily made with the dead-front electrical plug 100 in the open condition shown in FIG. 8.

Figure 10:
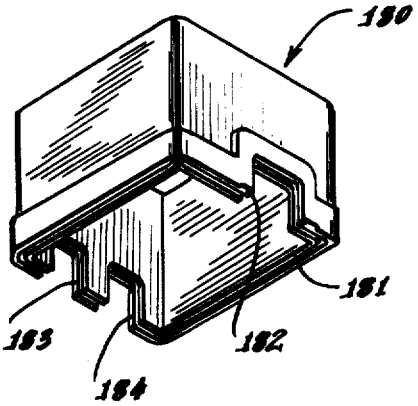
FIG. 10 is a perspective view of a sealing compound barrier for the electrical plug connector of FIG. 7.

An optional, generally rectangular sealing compound barrier sleeve 180, shown in FIG. 10, is fitted over and surrounds the upper ends of the power blades, ground pin, and the wiring connections thereto. The sealing compound barrier sleeve has a groove 181 formed in its lower edge, and the groove 181 receives the circumferential flange 135 of the dead-front member 120. The inside edge of the sealing compound barrier sleeve 180 is received in groove 136 adjacent to flange 135. The lower edge of the sealing compound barrier sleeve 180 is notched at 182, 183 and 184, and notch 182 fits over the more closely spaced dowel pins 130 and 131. The notches 183 and 184 fit over the other more widely spaced dowel pins 132 and 133. A sealing compound (not shown) is placed in the sealing compound barrier sleeve 180, and in this regard it should be noted that the sealing lips such as sealing lip 128 in the opening 125 for power blade 102, prevent any sealing compound from leaking through the dead-front member 120 around the power blades or ground pin.

The side covers 140 and 160 are pivoted together about the web hinges 110 and 111. It will be noted that the side covers 140 and 160 are similarly shaped and fit together to form a smooth exterior of the dead-front electrical plug 100. In particular, the flange 145 and shoulder 146 of side cover 140 interlock with the flange 165 and shoulder 166 of side cover 160 to provide a relatively dust-proof joint which also protects against the insertion of foreign objects into the wiring area.

The prongs 156 and 157 of side cover 140 are received in the openings 176 and 177, respectively, of side cover 160, and the prongs thereby maintain the side covers in alignment against misaligning forces created as the cord 113 is clamped between the criss-crossed cord clamp teeth 150, 151, 170 and 171. The dowel pins 130–133 fit snugly into the openings 158, 159, 178 and 179 in the side covers. This interengagement between the dowel pins and the side covers bears any longitudinal forces exerted between the side covers and dead-front member 120, such as those created in pulling the dead-front electrical plug 100 from an electrical socket outlet, and relieve what would otherwise be a stress on the web hinges 110–111. The flanges 148 and 168 fit into the grooves 123 in the dead-front member 120, and the flanges 147 and 167 fit into the other groove 122 formed in the dead-front member 120. The interengagement between flanges 147, 148, 167 and 168 and grooves 122 and 123 bears any lateral forces created between the side covers and the dead-front member 120, thus completing full stress protection of the web hinges 110 and 111. The covers are secured together by self-tapping screws 186 and 187 which are inserted through the openings 174 and 175 in side cover 160 and are threaded into the openings 154 and 155 in side cover 140.

Referring now to FIGS. 11–21, there is shown a third embodiment 200 of a dead-front electrical connector according to the invention herein. It generally comprises a connector body or housing 201 and electrical contacts, such as male contacts comprising two power blades 202 and 203 and a ground pin 204. The dead-front electrical connector 200 is adapted to make electrical connection between a cord 213, comprising three individually insulated wire conductors 214, 215 and 216, and a grounded electrical recepticle which is not shown. The body or housing 201 of the dead-front electrical connector 200 is generally comprised of a dead-front member or base 220 and two side covers 240 and 260 which are pivotally connected to the base 220 by web hinges 210 and 211. The entire connector body or housing 201 is integrally formed, as by molding, of an insulating material which may be nylon.

The dead-front base 220 of the connector housing 201 comprises a base plate 221, the outer surface of which forms a smooth insulating front face **221*a* of the connector 200. A pair of parallel grooves or recesses 222 and 223 are formed into the back side of the base plate 221 at opposite sides thereof but do not go through it. A similar pair of grooves or recesses 222*a* and 223*a* are formed into the base plate 221 adjacent the recesses 222 and 223. In order to simplify forming the housing 201 by a molding process, the recesses 222*a* and 223*a* go through the entire thickness of the base plate 221 so that the mold can form each with a lip such as the lip 223*a*' seen best at FIGS. 17 and 18. The purpose of these recesses is to engage mating locking portions integrally formed with the side covers 240 and 260**, as discussed in greater detail below.

A thicker central portion 224 of the dead-front base 220 is formed integrally with the base plate 221 thereof and serves as a supporting and mounting block for the contacts which, in this illustrative case, are shown as the power blades 202 and 203 and the ground pin 204. To this end, two rectangular openings 225 and 226, and a U-shaped or an O-shaped opening 227 are formed through the central portion 224 and integral base plate 221 to receive the power blades 202 annd 203 and the ground pin 204 respectively. One or more of the openings 225, 226, and 227 may be provided with a sealing sleeve, e.g., sealing sleeve 228 of opening 225, which sleeve extends longitudinally, i.e., along the vertical direction in FIG. 11, into the opening 226. The power blades 202 and 203 and the ground pin 204 are pushed down (in the down direction in FIG. 11) through the openings 225, 226 and 227, respectively, to the positions illustrated in FIGS. 11–21. The power blades 202 and 203 may be retained in their positions by barbs formed integrally therewith, such as barbs 208 of power blade 202. The ground pin 204 may have similar barbs though they are not shown in FIGS. 11–21.

The power blades 202 and 203 and the ground pin 204 are integrally formed with insulation displacement terminals 205, 206 and 207, respectively, which extend above the thickened portion 224 of the base 220 and are for the purpose of making wiring connections with the three wire conductors 214, 215 and 216 of cord 213, as described in greater detail below. An insulation barrier wall 229 is integral with and upstanding from the central thickened portion 224 of the dead-front base 220 and serves to isolate the terminals 205, 206 and 207 from each other.

A pair of dowel pins 230 and 232 protrude laterally from opposite sides (right and left in FIG. 13) of the dead-front base 220. More particularly, the dowel pins 230 and 232 flank the ground pin 204 and protrude laterally outwardly in opposite directions. The purpose of the dowel pins 230 and 232 is to engage with mating locking portions of the side covers 240 and 260, respectively, when the side covers are closed to provide a locking connection, as discussed in greater detail below.

Figure 16:
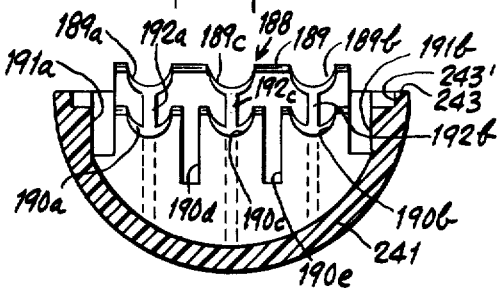
FIG. 16 is a sectional view taken along lines 16—16 of FIG. 14.
Figure 21:
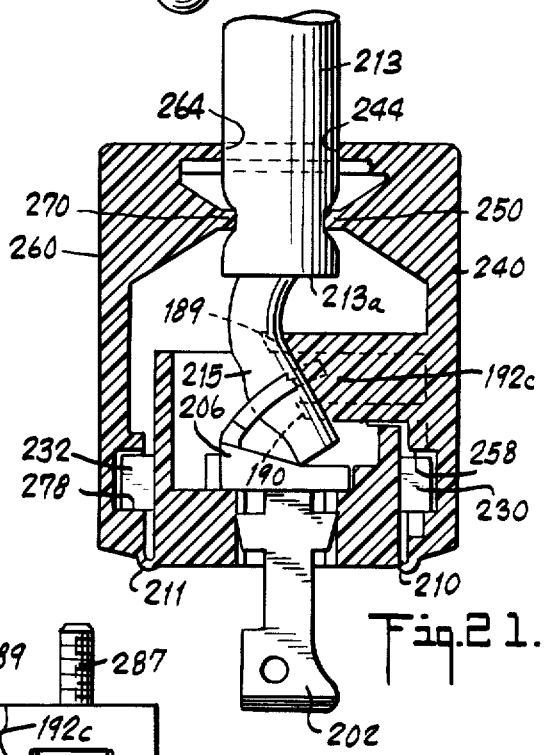
FIG. 21 is a view similar to that in FIG. 20 but showing the connector in its closed position and the cord conductor wired to the connector.

The first side cover 240 comprises a panel 241, which in the illustrated case is semi-circular in section as best seen in FIG. 16. The web hinge 210 which connects the front end of the side cover 240 to the base 220 is integrally formed with both and comprises a thin web of the same material. The periphery of the panel 241 which faces the other side cover 260 is formed with a recess 243' and a flange 243 which, as explained below, engage with a mating lip and recess of the second side cover 260. The back end of the side cover 243 is formed with a semi-circular opening 244 to permit passage of the cord 213 and possibly a surrounding sealing grommet which is not shown. A pair of flanges or lugs 247 and 248 protrude from opposite sides of the side cover 240 toward the base 220, to be received into the recesses 222 and 223 of the base 220, respectively, when the side cover 240 is pivoted about the hinge 210 and is brought to its closed position illustrated in FIGS. 11 and 18, as discussed in greater detail below. A cord clamp 250 extends diagonally between two thickened portions 252*a* and 252*b* of the back panel 241, and a strengthening rib 253 may also be provided in connection with the cord clamp tooth. Two openings 254 and 255 are formed through the side cover 240 and are counter-sunk into the outside surface of the panel 241, as best seen in FIG. 12, for use in connection with assembly screws discussed in greater detail below. The first side cover 240 also has a portion formed with a recess 258 which matingly receives the dowel pin 230 as best seen in FIG. 21, when the side cover 240 is in its closed position.

In addition, the first side cover 240 includes a pusher block generally indicated at 188 in FIG. 16 which, as explained in greater detail below, serves to make an insulation displacement connection between the wires of the cord 213 and the terminals 205, 206 and 207 as the first side cover 240 is brought to its closed position. The pusher block comprises a top shelf 189 and a bottom shelf 190 which are generally parallel to the front face 221*a* when the connector is closed or folded but are spaced from each other so as to permit the free ends of the terminals 205, 206 and 207 to enter in the space between them. The top pusher shelf 189 is formed with semi-circular recesses 189*a*, 189*b* and 189*c* which are aligned with the terminals 205, 206 and 207, respectively, and are dimensioned to partly receive the insulated conductors 214, 215 and 216. The bottom pusher shelf 190 is formed with similar semi-circular recesses 190*a*, 190*b* and 190*c* which are similarly disposed and shaped. In addition, the bottom pusher shelf 190 has a cutout 190*d* disposed and dimensioned to receive a portion of the barrier wall 229 which is between the terminals 205 and 207, and a similar cutout 190*e* similarly shaped and disposed to receive a portion of the barrier wall 229, which is between the terminals 206 and 207. A further recess 191*a* is disposed and shaped to receive a portion of the barrier wall 229 which is on the outward side of the terminal 205 and another recess 191*b* is shaped and disposed to receive a portion of the barrier wall 229 which is on the outward side of the terminal 206. Strengthening ribs 192*a*, 192*b* and 192*c* connect the two pusher shelves 189 and 190 and are dimensioned and positioned to enter into mating insulation displacement slots 205*a*, 206*a* and 207*a* of the terminals 205, 206 and 207, respectively, when the first cover 240 is brought to its closed position.

Figure 17:
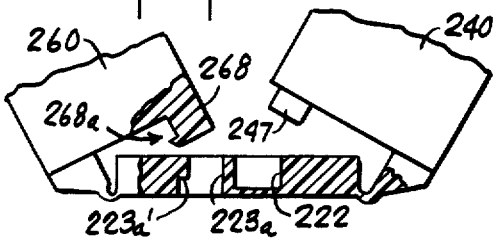
FIGS. 17 and 18 are partly sectional and partly side elevational views of a portion of the connector of FIG. 11 illustrating the operation of selected locking means.
Figure 18:
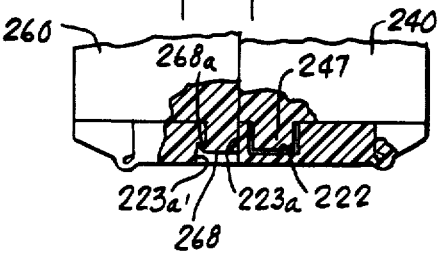
Figure 19:
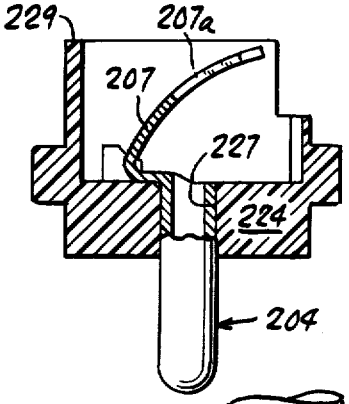
FIG. 19 is a partial sectional view taken along lines 19—19 of FIG. 13.

The second side cover 260 is similar to the first side cover 240 and comprises a similar panel 261. The second side cover 260 is hingedly connected to the deadfront member 220 by web hinge 211. A wall 263 extends around the periphery of the panel 260 which faces the first side cover 240, and the wall 263 is in the form of a flange which protrudes toward the side cover 240 from a surrounding recess 263' such that when the connector is folded or closed to the position shown in FIGS. 11 and 21, the wall 243 of the first side cover 240 fits in the recess 263' of the second side cover 260 and the wall 263 of the second side cover 260 fits in the recess 243' of the first side cover 240. The wall 263 includes a semi-circular opening 264 which cooperates with the opening 244 in wall 243 to accommodate passage of the cord 213 and of a possible associated grommet, not shown. A pair of flanges or lugs 267 and 268 extend from opposite side of the side cover 260 toward the base 220 and are positioned and dimensioned to be engaged matingly by the recesses 222*a* and 223*a*, respectively, of the base 220 when the side cover 260 is brought to its closed position. As best seen in FIGS. 17 and 18, the flange or lug 268 has a locking tooth 268*a* dimensioned and positioned to snap against a lip 223*a'* in the recess 223*a* when the side cover 260 is brought to its closed position so as to permanently retain the side cover 260 in said closed position. A cord clamp tooth 270 extends diagonally between blocks 272 and 273 which are formed integrally with the side cover 260, and may have a strengthening rib 270*a*. The cord clamp teeth 250 and 270 are oriented such that they crisscross when the connector is assembled so as to suitably deform the cord 213 and grip it securely. Two openings 274 and 275 are formed partially into the blocks 272 and 273, respectively, to receive self tapping assembly screws passed through the openings 254 and 255 of the first side cover 240, as discussed in greater detail below. The second side cover 260 also has a recess 278 dimensioned and positioned to matingly receive the dowel pin 232 when the second side cover is in its closed position.

Figure 20:
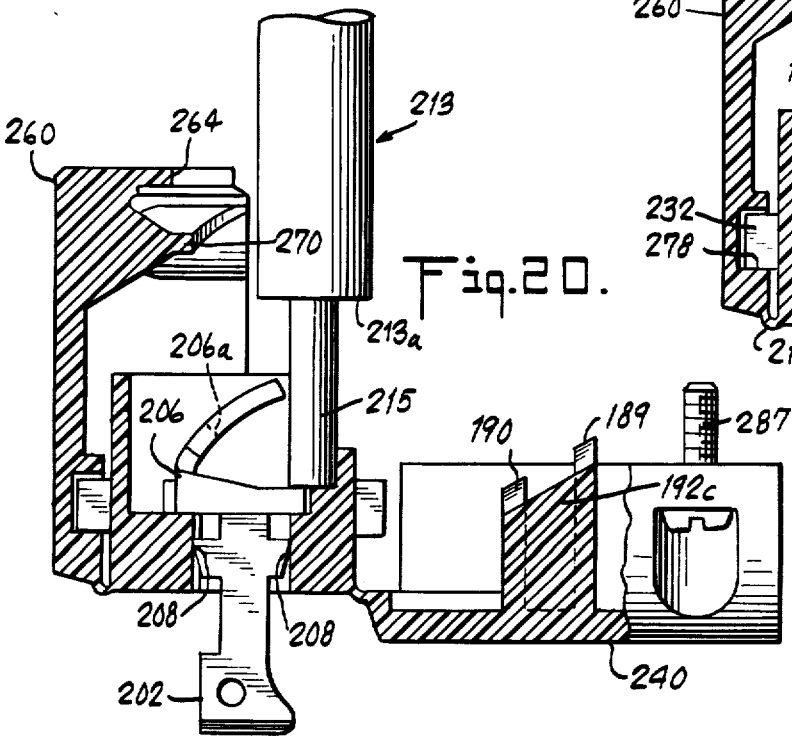
FIG. 20 is a view similar to that shown in FIG. 14 but showing a cord and an individually insulated conductor thereof in position for wiring to the connector.

The connector illustrated in FIGS. 11-21 is assembled as follows. The power blades 202 and 203 and the ground pin 204 are forced down into their respective openings 225, 226 and 227 to the positions illustrated in FIGS. 14 and 19. The second side cover 260 is then brought from the open position shown in solid lines in FIG. 14 to the closed or folded position shown in broken lines in the same figure. Note that, as best illustrated in FIG. 18, when the second side cover 260 is brought to its closed position it is permanently locked in that position by the engagement of the locking teeth 267*a*, 268*a* and the lips 222*a'*, 223*a'*. To wire the terminal, the outer insulation 213*a* of the cord 213 is stripped for a length short enough to permit the outer insulation 213*a* to be gripped by the clamp teeth 250 and 270 when the connector is assembled and the three wire conductors 214, 215 and 216, with their individual insulations intact, are placed into the respective recesses formed by the barrier walls 229 for the respective terminals 205, 206 and 207, as illustrated in FIG. 20 for the wire 215. Note that the insulation displacement slots of the terminals have widened lead-ins at their free ends to facilitate alignment of the insulated wires with the respective slots. Moreover, the lead-ins or the slots or both may be thined out or sharpened to help cut through the insulation of the wires being pushed into the terminal slots. Note also that the width of the slot is no greater than the respective diameters of the conductor wires to be wired thereto and that the barrier walls 229 are closely adjacent to the tines forming the terminal slots so as to constrain the tines and prevent undesirable opening and setting of the slots due to slot spreading forces when the wires are being pushed into them. Note also that the terminal slots are staggered, that is, the slot 207*a* extends further to the right side of FIG. 13 than the other two slots. If desired, the other two terminal slots may also be staggered with respect to each other. This staggering is for the purpose of avoiding having to force all three wires 214, 215 and 216 simultaneously through the respective lead-ins of their terminals, thus avoiding excessive stress and strain.

After the second side cover 260 is brought to its closed position illustrated in FIG. 20, and the three wires 214, 215 and 216 are placed at the lead-ins of their respective terminal slots 205*a*, 206*a* and 207*a* in the manner illustrated for the wire 215, the first side cover 240 is pivoted about the hinge 210 toward the second side cover 260. The upper and lower pusher shelves 189 and 190 engage the portions of the wires 214, 215 and 216 immediately above and immediately below the lead-ins of the terminals. In particular, since the lead-in of terminal 207 extends furthest toward the side cover 240, the recesses 189c and 190c and the rib 192c engage the wire 216 before the other wires 214 and 215 are similarly engaged. As the first side cover 240 is moved further toward its closed position the wire 216 is forced through the lead-in of terminal 207 into its insulation displacement slot 207a, in the process of which the terminal cuts through the insulation of the wire 216 and makes electrical contact with the electrical conductor thereof. Note that the rib 192c enters into the terminal slot 207a to push the wire 216 further therein as the first side cover 240 is brought to its fully closed position. The wires 214 and 215 are similarly forced into the slots 205a and 206a, respectively, by the respective recesses 189a and 190a and rib 191a, and recesses 189b and 190b and rib 192b, as the first side cover 240 moves further toward its closed position. When the first side cover 240 reaches its closed position it has not only helped make electrical contact between the terminals and the wires but it has also helped fully enclose the wiring area and grip the cord 213 between the cord clamp teeth 250 and 270 as illustrated in FIG. 21. The fact that the slots 205a, 206a and 207a extend along curves which are substantially arcs of a circle centered at the hinge 210 helps facilitate breaking through the insulation of the wires 214, 215 and 216 as the first side cover 240 is brought to its closed position. The back portions of the two side covers 240 and 260 are secured to each other by assembly screws 286 and 287 which pass through openings 254 and 255, respectively, in the first side cover 240, and are self tapping into partial openings 274 and 275, respectively, of the second side cover 260. The first side cover may be moved by hand toward its closed position until it starts engaging at least the wire 216, and the assembly screws 286 and 287 may be then turned by a screwdriver or otherwise to exert the remainder of the force necessary to assemble the connector completely.

When the two side covers 240 and 260 are in their closed positions, as shown in FIG. 21, the lugs 230 and 232 are matingly received in the recesses 258 and 278, respectively, and resist relative motion between the base 220 and the side covers 240 and 260 in the longitudinal direction (i.e., in the vertical direction in FIG. 21) and in a lateral direction parallel to the hinges 210 and 211. The lugs 267 and 268 are received in their respective recesses 222a and 223a, as illustrated for the lug 268 in FIG. 18 and the respective locking teeth 267a and 268a are locked against the respective lips 222a' and 223a', as illustrated in FIG. 18 in the case of the lug 268. This permanent locking arrangement between the lugs 267 and 268 and the respective recesses 222a and 223a resists relative movement between the second side cover 260 and the base 220 in the longitudinal direction as well as in any lateral direction transverse to the longitudinal one. The engagement of the lugs 247 and 248 of the first side cover 240 into the recesses 222 and 223 of the base 220 resists movement of the first side cover 240 relative to the base in any lateral direction transverse to the longitudinal one. These engagements between locking or mating portions integrally formed with the base and side cover, relieve forces which might act on the web hinges 210 and 211 and permit the connector to be assembled or reassembled conveniently and to be used safely even if one or both of the web hinges 210 and 211 are weakened or torn.

The connector illustrated in FIGS. 11-21 may be used as a plug having male contacts, as illustrated, or as a connector having female contacts, not illustrated, in place of the blades 202 and 203 and the ground pin 204. Each of such female contacts would be electrically connected, as by being integrally formed, with a respective one of the insulation displacement terminals 205, 206 and 207. Alternately, the connector illustrated in FIGS. 11-21 may have one or more male contacts and one or more female contacts.

Thus, the dead-front electrical connectors illustrated in FIGS. 1-21 are made up of a single molded housing or body to which only electrical contacts and terminals and perhaps assembly screws need be added, which achieves low manufacturing and assembly cost. No separate parts are likely to be lost during wiring, and the open position of one or both of the side covers allows complete access to the wiring area. In the case of the connector shown in FIGS. 11-21, the variability of workmanship associated with screw-type terminals is eliminated both with respect to the quality of stripping conductor ends and with respect terminal screw tightening torques. The interlocking of the side covers and base of all of the connectors discussed above relieve stresses on the web hinges and provide a strong structure which remains fully insulated and serviceable despite possible weakening or failure of the web hinges.

I claim:

1. A dead-front connector having a housing for electrical terminals to which conductors of an electrical cord may be wired comprising:

a dead-front base having a front face and at least a pair of openings for passage of electrical contacts through the base, a pair of side covers having respective front end and back ends, and a pair of web hinges connecting the front ends of the respective side covers to the dead-front base for pivoting the side covers about respective hinge axes which extend adjacent said front face, said side covers pivoting between respective closed positions in which the back ends, of the side covers are next to each other and are spaced from the front ends thereof along a longitudinal axes and an open position in which the back-ends of the side covers are apart and are spaced from each other along a lateral axis transverse to said longitudinal axis, said dead-front base and side covers and web hinges integrally molded as a unitary structure made of an electrically insulating material;

locking means which are in addition to said web hinges and comprise base portions molded integrally with said dead-front base and side portions molded integrally with said side covers, said base and side portions engaging each other matingly when the side covers are in the closed positions to resist movement of at least the front portions of the side covers relative to the dead-front base along said longitudinal axis as well as along said lateral axis transverse to said longitudinal axis, and at least one electrical terminal located within said housing for making electrical contact with a conductor of an electrical cord, and an integral pusher portion on the interior surface of at least one of said side covers, in cooperating relationship with said electrical terminal, for forcing an insulatingly covered conductor against said terminal to displace its insulating cover and establish an electrical contact between the conductor and said electrical terminal.

2. A dead-front connector as in claim 1 including at least a pair of electrical terminals each made of an electrically conductive material and disposed within said housing adjacent a respective one of said openings in the dead-front base, each terminal having an insulation displacement slot which is behind said front face of the base and extends generally transversely of the longitudinal axis and has a lead-in end open toward said pusher portion, the first side cover including a raised portion forming a pusher block molded integrally therewith and comprising a pusher shelf extending, when the first side cover is in its closed position, generally along at least a portion of each of the terminal slots and adjacent thereto, whereby an electrical conductor with intact insulation may be placed at the lead-in end of each terminal slot when the first side cover is in its open position and pushed into the slot by the pusher block as the first side cover is brought to its closed position to have its insulation broken through by entry into the terminal slot to make electrical contact therewith.

3. A dead-front connector as in claim 2 wherein the insulation displacement slot of each terminal is curved and extends generally along an arc of a circle centered at the first hinge axis.

4. A dead-front connector as in claim 2 wherein the pusher block comprises a pair of shelves which are spaced from each other along the longitudinal axis when the first side cover is in its closed position, said pusher block receiving a portion of each terminal between its shelves to thereby push an electrical conductor into the terminal slot from both sides of the slot.

5. A dead-front connector as in claim 4 wherein the relative dimensions of the two pusher shelves are such that when the first side cover is in its closed position, the pushing ends of the two pusher shelves overlap and extend substantially beyond the ends of the electrical terminals.

6. A dead-front connector as in claim 2 wherein the relative dimensions of at least two of said terminal slots and said pusher shelf are such that as the first side cover is being closed the pusher shelf overlaps with one of the terminal slots before overlapping with the other, to thereby push an electrical conductor partway into one slot before starting to push an electrical conductor into the other slot, and reduce the force needed to close the first side cover as compared to that needed to simultaneously start forcing both conductors into their respective terminal slots.

7. A dead-front connector as in claim 1 having at least two electrical terminals within said housing, each containing a slot for receiving a conductor of an electrical cord, wherein said locking means includes mating means securely engaging each other when the second side cover is brought to its closed position to retain the second side cover in said closed position and thereby permit the use of the second side cover as a convenient backup for clamping the electrical cord having the conductors to be engaged in said terminal slots.

8. A dead-front connector as in claim 7 wherein said locking means comprise a locking tooth with a projecting lug molded integrally with one of said dead-front base and second side cover and a mating locking recess having a shoulder integrally molded within the other of said dead-front base and second side cover, said locking tooth and locking recess engaging each other matingly, with the projecting lug constrained by the shoulder, when the second side cover is brought to its closed position to inhibit subsequent pivoting of the second side cover toward its open position.

9. A dead-front connector as in claim 2 wherein the dead-front base includes barrier walls which are integrally molded with the dead-front base and extend along the longitudinal axis and are disposed on opposite sides of each of said insulation displacement terminals, the barrier walls being closely adjacent each insulation displacement terminal in a direction transverse to the slot of the terminal to thereby prevent undesirable opening of the slot due to forces thereon resulting from pushing a conductor into the slot.

10. A dead-front connector as in claim 1 wherein said locking means comprise, for each side cover, at least one pair of a side cover portion and a mating base portion which, when engaged matingly, resist relative motion between the side cover and the dead-front base along the longitudinal axis and along one lateral axis, and at least a second pair of a side cover portion and a base portion which, when engaged matingly, resist movement of the side cover relative to the base member at least along any other lateral axis in the plane of said one lateral axis.

11. A dead-front connector as in claim 10 wherein the second pair of locking means, for at least one of said side covers, resist movement of said one side cover relative to the base portion along the longitudinal axis as well as along said any other lateral axis.

12. A dead-front connector as in claim 11 wherein the second pair of locking means include means for restraining said one side cover from further pivoting towards its open position once it has been moved to its closed position.

13. A dead-front connector having a housing for electrical terminals to which conductors of an electrical cord may be wired comprising:

a dead-front base having a front face and at least a pair of openings for passage of electrical contacts through the base, at least one side cover having a front end and a back end and a web hinge connecting the front end of the at least one side cover to the dead-front base for pivoting the at least one side cover about a hinge axis which extends adjacent said front face, said side cover pivoting between a closed position in which its back end is spaced from the front face along a longitudinal axis transverse to the front face and an open position in which its back end is spaced from the base along a lateral axis transverse to said longitudinal axis, said dead-front face and side cover and web hinge being integrally molded as a unitary structure made of an electrically insulating material;

locking means which are in addition to said web hinge and comprise base portions molded integrally with said dead-front base and side portions molded integrally with said at least on side cover, said base and side portions engaging each other matingly when the at least one side cover is in its closed position to resist movement of at least the front end of the at least one side cover relative to the dead-front base along said longitudinal axis as well as along any lateral axis; and at least a pair of terminals each made of an electrically conductive material and disposed adjacent a respective one of said openings in the dead-front base, each terminal having an insulation displacement slot which is behind said front face of the base and extends generally transversely of the longitudinal axis and has a lead-in end open toward said at least one side cover, said side cover including a pusher block molded integrally therewith and extending, when the side cover is in its closed position, generally along at least a portion of each of the terminal slots and adjacent thereto, whereby an electrical conductor with intact insulation may be placed at the lead-in end of each terminal slot when the side cover is in its open position and pushed into the slot by the pusher block as the side cover is brought to its closed position to have its insulation broken through by the terminal slot and to make electrical contact therewith.

14. A dead-front connector having a one-piece housing for electrical terminals and permitting electrical contact thereto through apertures in the dead-front, the housing having a longitudinal axis, comprising:

a base member constituting the dead-front of the housing and being disposed transverse to the longitudinal axis, electrical terminals mounted on said base member, said base member composed of electrical insulating material and having apertures therethrough for electrical connection from said terminals to external electrical circuitry, at least two side casings composed of electrical insulating material and having respective first and second ends, web hinge means joining the first end of each of said side casings to said base member to form a unitary structure and to permit pivoting movement of said casings from a closed position which is generally longitudinal and encloses said terminals to an open position which renders the terminals accessible for wiring, and a plurality of interlocking members at least one of which is located on each of said side members adjacent the first end thereof, and at least a corresponding number of which are located on the base member, one on the base member being in cooperating relationship with each one on the side casings, said interlocking members removing both transverse and longitudinal stress from the web hinges when the side casings are closed and locking the side casings to said base member against relative displacements both transverse to and parallel to said longitudinal axis, said electrical terminals each having a conductor receiving surface for receiving an insulated conductor of an electrical cord and cutting through the insulation around the conductor to establish electrical contact, the receiving surface of each such terminal extending toward one of said side casings, and the receiving surface of a first terminal extending closer to said one side casing than the receiving surface of a second terminal, said one side casing, as it moved to its closed position, forcing an insulated conductor against the receiving surface of said first terminal and, thereafter, forcing another insulated conductor against the receiving surface of said second terminal.

15. A housing with electrical terminals to which a conductor of an electrical cord may be electrically wired, the housing having a longitudinal axis and comprising:

a base member of insulating material disposed transverse to the longitudinal axis, electrical terminals disposed within said housing, said base member containing apertures for electrical connection between said terminals and external electrical circuits, at least two side casings composed of electrical insulating material for enclosing said terminals, each of said side casings having first and second ends, web hinge means joining the first end of each of said side casings to said base member to form a unitary structure and to permit pivoting of said side casings, about respective axes transverse to said longitudinal axis, from a closed generally longitudinal position enclosing said terminals to an open transverse position providing access to the terminals, locking means adjacent the first end of each of the side casings, exclusive of the web hinge means, for locking the side casings to said base member against relative displacement transverse to said longitudinal axis when the casings are closed, said locking means including interengaging locking members, one on the base member and one on a side casing, for each of the side casings, said interengaging locking members engaging one another when the respective side casing is closed, and the interengaging locking members for at least one of said side casings including a projection on one of the interengaging locking members and a shoulder on the other, the projection locking behind the shoulder when said one side casing is closed to hold said one side casing fixedly in a closed position.

16. A wiring device to which conductors of an electrical cord may be wired, comprising:

a housing including a base member having an outer face, an inner face and a plurality of spaced apart openings extending through said base member from said inner face to said outer face, a plurality of elongated electrical blade contacts for making electrical connections with the mating contacts for another wiring device upon the coupling together of the two devices, each of said blade contacts having an outer and an inner portion, the outer portion of each of said blade contacts disposed in substantial alignment with a respective one of the openings, the inner portion of each of said blade contacts located inwardly of said inner face of said base member, at least one side cover having a front end and a back end, a web hinge connecting the front end of the one side cover to said base member for pivoting said side cover about a hinge axis which extends adjacent said base member, said side cover pivoting about said web axis from an open position to a closed position wherein the side cover covers said inner face of said base member, said base member, side cover and web hinge being integrally molded as a unitary structure made of an electrical insulating material, a plurality of terminals fixedly mounted within said housing inwardly of said inner face of said base member composed of an electrically conductive material, each of said terminals joined as an integral part of the inner portion of a respective one of said blade contacts to provide an electrical termination therefor, and having an insulation displacement slot therein with a lead-in end open toward said side cover, a plurality of pusher members within said housing mounted for displacement by said one side cover, each pusher member being substantially aligned with the lead-in end of a respective slot when said side cover is closed, whereby an electrical conductor with intact insulation may be placed at the lead-in end of each terminal slot when said side cover is in its open position and pushed into the slot by a pusher member as said side cover is brought to its closed position to have its insulation broken through by the terminal slot to make electrical connection with a respective one of said terminals.

17. The device according to claim 16 wherein said terminals depend from said blade contacts and wherein an angle is formed between the depending portion of each terminal and its respective contact and that angle is an acute angle.

18. The device according to claim 17, wherein said blade contacts are male contact blades which project from the outer face of said base member.

19. The device according to claim 16 wherein said pusher members are mounted on the inner surface of said side cover and wherein said terminals are arcuate and substantially parallel to the paths of travel of said pusher members upon their movement with said side cover.

20. The device according to claim 16 wherein one of said terminals is spaced laterally from the other of said terminals.

21. The device according to claim 19 wherein one of said terminals is spaced laterally from the other of said terminals, and wherein both of said terminals have an arcuate shape substantially conforming to the respective paths of travel of respective ones of said pusher members upon their movement to a position where said side cover is closed.

22. The device according to claim 21 wherein said pusher members are formed as an integral part of said side cover.

23. The wiring device according to claim 16, and further comprising, means mounted on the first end of said side cover engageable with said base member for relieving stress on said web hinge as said pusher members force the electrical conductors into respective terminal slots.

24. An electrical wiring device to which an electrical cord may be electrically wired, the device having a longitudinal axis and comprising a housing including a base composed of insulating material disposed transverse to the longitudinal axis and having a plurality of spaced apart openings extending longitudinally therethrough, a plurality of contact blades for making selective electrical connections to mating contacts of a second wiring device when the wiring devices are coupled together, each of said blades having an inner and an outer end, the outer end of each blade being disposed in substantial alignment with a respective one of said openings, a plurality of electrical terminals mounted within said housing for electrical connection to the conductors of the electrical cord, each of said terminals being integral with an inner end of a respective one of said blades and being electrically isolated from one another, at least two side casings composed of electrical insulating material for enclosing said terminals, each of said side casings having first and second ends, a web hinge joining the first end of each of said side casings to said base member to form a unitary structure and to permit pivoting of said side casings about respective axes transverse to said longitudinal axis, from a closed generally longitudinal position enclosing said terminals to an open transverse position providing access to the terminals, each of said terminals having an insulation displacement means associated therewith, at least one pusher member mounted on the inner surface of one of said side covers, the one pusher member being in substantial alignment with said insulation displacement means when the one side cover is closed, whereby a given electrical conductor of the electrical cord with intact insulation may be aligned for contact with the insulation displacement means associated with a given terminal when the side cover is in its open position and forced into contact with said insulation displacement means as said one side cover is brought to its closed position until the insulation is broken, whereby the conductor makes an electrical connection with a respective one of said terminals.

25. The wiring device according to claim 24 and further comprising, a plurality of screw means engaging the ends of said side casings opposite said base, said screws located on opposite sides of the electrical cord with their longitudinal axes substantially perpendicular to the longitudinal axis of the cord for assisting closure of the side casings and the movement of the pusher members toward the insulation displacement means upon rotation thereof.

26. An electrical wiring device to which an electrical cord including a plurality of individual, insulated conductors may be electrically wired, the device having a longitudinal axis and comprising:

a housing including a base of insulating material disposed transverse to the longitudinal axis and having a plurality of spaced-apart openings extending longitudinally therethrough, a plurality of elongated contact blades fixedly mounted on said base for selective connection to mating contacts of a second wiring device upon the coupling of the two wiring devices, each of said contact blades having an inner and an outer end, the outer end of each blade being disposed in substantial alignment with a respective one of said openings, a plurality of electrical terminals mounted within said housing, each of said terminals being integral with an inner end of a respective one of said blades, at least two side casings composed of electrical insulating material for enclosing said terminals, each of said side casings having first and second ends, web hinge means joining the first end of one of said side casings to said base member to form a unitary structure and to permit pivoting of said side casing about an axis transverse to said longitudinal axis, from a closed generally longitudinal position enclosing said terminals to an open generally transverse position providing access to the terminals, each of said terminals having an insulation displacement means integral therewith, each insulation displacement means being electrically isolated from another insulation displacement means, pusher means mounted on the inner surface of said one side casing, said pusher means having portions thereof disposed relative to said insulation displacement means such that when said one side casing is closed, an electrical conductor with intact insulation thereon in line with said insulation displacement means has its insulation covering displaced sufficiently for the corresponding conductor to make an electrical connection with a corresponding one of said terminals.

27. The wiring device according to claim 26 wherein the ends of said side casings opposite said base clamp the electrical cord therebetween by means of a plurality of screws passing through one of said side casings and engaging the other of said side casings, said screws being located on opposite sides of the electrical cord with their longitudinal axes in a plane substantially perpendicular to the longitudinal axis of the cord.

28. The wiring device according to claim 27 and further comprising, means mounted on the first end of said one side casing engageable with said base for relieving stresses on the web hinge as said pusher means forces an electrical conductor against an associated insulation displacement means.

29. The wiring device according to claim 26 wherein at least one of said insulation displacement means comprises a set of spaced-apart electrically conductive elements, each set having opposing edges defining a slot therebetween, the slot having a lead-in end open toward said one side casing, said set of elements extending transverse to the longitudinal axis of a respective contact blade.

30. The wiring device according to claim 29 wherein the longitudinal axes of said contact blades are substantially parallel to the longitudinal axis of the cord portion within the wiring device and further, wherein each of said contact blades mounts a set of said elements, the sets of elements being mounted in spaced-apart relationship on said base to provide electrical isolation therebetween.

31. The wiring device according to claim 30 and further comprising, at least two externally threaded screws passing through one of the side casings and engaging the other side casing at the end of the device opposite the base end, said screws positioned adjacent the edges of the side casings on opposite sides of the electrical cord, said screws having their longitudinal axes substantially perpendicular to the longitudinal axis of the housing and engaging the one side casing upon rotation thereof to force the pusher means toward said insulation displacement means while effecting closure of the one side casing.

32. A wiring device to which conductors of an electrical cord may be connected, comprising:

a housing including a base member having an outer face, an inner face and a plurality of spaced apart openings extending through said base member from said inner face to said outer face, a plurality of elongated electrical contacts for making electrical connections with the mating blade contacts of another wiring device upon the coupling together of the two devices, each of said blade contacts having an outer and an inner portion, the outer portion of each of said blade contacts disposed in substantial alignment with a respective one of the openings, the inner portion of each of said contacts located adjacent said inner face of said base, member, at least one side cover having a front end and a back end, a web hinge connecting the front end of the one side cover to said base member, said side cover pivoting on said web hinge from an open position to a closed position wherein the side cover covers said inner face of said base member, said base member, side cover and web hinge being formed as a unitary structure made of an electrical insulating material, a plurality of contact terminations mounted within said housing adjacent said inner face of said base member composed of an electrically conductive material, each of said terminations having one end thereof attached to the inner portion of a respective one of said contacts, at least one insulation penetrating surface formed on each of said terminations along a second end, opposite said one end, which second end extends laterally outward from its respective contact toward said side cover; and a recess in the interior of said side cover receiving the second end of said one termination when said side cover is closed, and a pusher surface on said interior wall cooperating with said terminations to force insulation-bearing conductors against said insulation penetrating surfaces when said side cover is closed.

33. The device according to claim 32 wherein an angle is formed between the second end of said termination and its respective contact and that angle is an acute angle.

34. The device according to claim 32 wherein the recess is molded into said side cover.

35. The device according to claim 33 wherein the recess is defined by a first surface located in close proximity to said second end of said one termination between said second end and said outer face of said base member.

36. The device according to claim 35 wherein the recess is defined by a second surface located in close proximity to said second end of said termination between said second end thereof and an end of said housing opposite said outer face.

37. The device according to claim 32 wherein the recess is defined by two spaced-apart projections mounted on the interior wall of said side cover and extending inwardly thereof.

38. The device according to claim 37 wherein one of said projections is located further from the base member than the other projection and extends inwardly beyond the outer edge of said second end of said one termination and in close proximity thereto when the side cover is closed.

39. The device according to claim 32 wherein said one of said terminations is an integral part of its respective contact and has a shape substantially conforming to the path of travel of said recess upon its movement to a position where said side cover is closed.

40. A wiring device to which conductors of an electrical cord may be connected, comprising:

a housing including a base member having an outer surface, an inner surface and a plurality of spaced-apart openings extending through said base member from said inner surface to said outer surface, a plurality of elongated electrical blade contacts made of electrically conductive material for making electrical connections with the mating contacts of another wiring device upon the coupling together of the two devices, each of said blade contacts having an outer and an inner portion, the outer portion of each of said blade contacts disposed longitudinally in substantial alignment with a respective one of the openings, the inner portion of each of said blade contacts extending from said inner surface of said base member, at least one side cover having a front end and a back end, a web hinge connecting the front end of the one side cover to said base member, said side cover pivoting on said web hinge from an open position to a closed position wherein the side cover substantially encloses said inner surface of said base member, said base member, side cover and web hinge being formed as a unitary structure made of an electrical insulating material, said inner portion of at least one of said contacts extending laterally from its longitudinal axis toward said side cover and having an insulation penetrating surface; and a portion of the interior wall of said side cover in operating relationship with said insulation penetrating surface to force an insulation-bearing conductor against said surface when said side cover is closed.

41. The device according to claim 40 wherein the housing comprises a plurality of side covers and a plurality of web hinges on which said side covers can pivot from open to closed positions, and wherein at least two of said blade contacts have laterally extending inner portions and further wherein a plurality of projections are on the interior wall of at least one side cover each in operating relationship with a different one of said laterally extending inner portion of said contacts.

42. The device according to claim 41 wherein said projections are opposite one another.

* * * * *